US005092298A

United States Patent [19]

Suzuki et al.

[11] Patent Number: 5,092,298

[45] Date of Patent: Mar. 3, 1992

[54] FAIL-SAFE SYSTEM FOR THROTTLE VALVE CONTROLLER

[75] Inventors: Norio Suzuki; Hiroshi Kitagawa; Yoshio Wazaki, all of Saitama, Japan

[73] Assignee: Honda Giken Kogyo Kabushiki Kaisha, Tokyo, Japan

[21] Appl. No.: 665,834

[22] Filed: Mar. 7, 1991

[30] Foreign Application Priority Data

May 9, 1990 [JP] Japan ..... 2-119542

[51] Int. Cl.[5] ..... F02D 9/10; F02D 41/14

[52] U.S. Cl. ..... 123/361; 123/399

[58] Field of Search ..... 123/352, 361, 399, 403

[56] References Cited

U.S. PATENT DOCUMENTS

| | | | |
|---|---|---|---|
| 4,488,527 | 12/1984 | Pfalzgraf et al. | 123/399 |
| 4,519,360 | 5/1985 | Murakami | 123/399 |
| 4,612,615 | 9/1986 | Murakami | 123/399 X |
| 4,854,283 | 8/1989 | Kiyono et al. | 123/399 X |
| 4,909,213 | 3/1990 | Mezger et al. | 123/399 X |

FOREIGN PATENT DOCUMENTS

| | | | |
|---|---|---|---|
| 3327376 | 2/1985 | Fed. Rep. of Germany | 123/399 |
| 0119036 | 7/1984 | Japan | 123/399 |
| 2-06625 | 11/1984 | Japan | 123/399 |
| 0040745 | 3/1985 | Japan | 123/399 |
| 0075048 | 4/1987 | Japan | 123/399 |

*Primary Examiner*—Willis R. Wolfe

*Attorney, Agent, or Firm*—Armstrong, Nikaido, Marmelstein, Kubovcik & Murray

[57] ABSTRACT

In a throttle valve controller for controlling the opening and closing of a throttle valve in an internal combustion engine, the state of the throttle valve entering a sticking is detected from a difference between a target throttle valve opening degree and an actual throttle valve opening degree. When the throttle valve enters its sticking state, the amount of decrement in the output from the engine is calculated based on the current operational condition of the engine and an estimated value for the operational condition of the engine after elimination of the sticking. When the elimination of the sticking is detected on the basis of a sudden variation in throttle valve opening degree, the output from the engine is reduced by fuel cut on the basis of the amount of decrement in engine output. This prevents occurence of a sudden variation in output torque of the engine, which may otherwise be produced as a result of elimination of the sticking.

15 Claims, 4 Drawing Sheets

FAIL-SAFE SYSTEM FOR THROTTLE VALVE CONTROLLER

BACKGROUND OF THE INVENTION

1. Field of the Invention

The field of the present invention is fail-safe systems for a throttle valve controller for controlling the opening and closing of a throttle valve in an internal combustion engine through a motor.

2. Description of the Prior Art

In the prior art throttle valve controller used in a traction control system or an auto-cruise system, a throttle valve is connected to a motor and driven for opening and closing, or the throttle valve is connected to the motor through a lost motion mechanism and driven for opening and closing, in order to control the output torque from an internal combustion engine.

In such a throttle valve controller, however, if a sticking occurs due to any cause when the throttle valve is driven toward an opened side, the throttle valve may be suddenly brought to an open position by a spring force in a system including the lost motion mechanism interposed between the throttle valve and the motor, or by a driving force of the motor in a system which the throttle valve is connected directly to the motor. This may result in a sudden increase in the output torque from the internal combustion engine.

SUMMARY OF THE INVENTION

Accordingly, it is an object of the present invention to prevent occurrence of any sudden increase in the output torque from the internal combustion engine, when the sticking of the throttle valve in the internal combustion engine is eliminated.

To achieve the above object, according to the present invention, there is provided a fail-safe system for a throttle valve controller for controlling the opening and closing of a throttle valve in an internal combustion engine by a motor, comprising: a stick detecting means for detecting a sticking of the throttle valve; and an internal combustion engine output decrement calculating means for calculating, when the sticking is detected by the stick detecting means, an amount of output from the internal combustion engine to be reduced, based on a current operational condition of the internal combustion engine and an estimated value for an operational condition of the engine at the time of elimination of the sticking.

With the above construction, the amount of decrement of the output from the internal combustion engine required in order to previously prevent a sudden delivery of the output from the internal combustion engine after elimination of the sticking is calculated at an instant when the sticking of the throttle valve is detected and therefore, it is possible to deal with any sudden increase in the output from the internal combustion engine under any sticking condition and after elimination of the sticking.

In addition, according to the present invention, there is provided a fail-safe system for a throttle valve controller for controlling the opening and closing of a throttle valve in an internal combustion engine by a motor, comprising: a stick detecting means for detecting a sticking of the throttle valve; an alarm means for giving an alarm when the sticking is detected by the stick detecting means; a stick elimination detecting means for detecting elimination of the sticking detected by the stick detecting means; and an internal combustion engine output reducing means for reducing the output from the internal combustion engine when the elimination of the sticking is detected by the stick elimination detecting means.

With the above construction, an alarm is produced when the sticking of the throttle valve is detected, and the output from the internal combustion engine is reduced when the elimination of the sticking is detected. Therefore, it is possible to precisely deal with a sudden increase in the output from the internal combustion engine which may be produce as a result of elimination of the sticking.

Further, according to the present invention, there is provided a fail-safe system for a throttle valve controller for controlling the opening and closing of a throttle valve in an internal combustion engine by a motor, comprising: a stick detecting means for detecting a sticking of the throttle valve; an internal combustion engine output variation estimating means for estimating a difference in a variation of positive torque output from the internal combustion engine at the time of detecting elimination of the sticking, based on a throttle valve opening degree at a time when the sticking is detected by the stick detecting means and an estimated throttle valve opening degree after the elimination of the sticking; and an internal combustion engine output reducing means for reducing the output from the internal combustion engine in accordance with the difference in the positive torque output variation estimated by the internal combustion engine output variation estimating means.

With the above construction, a variation in the output from the internal combustion engine after elimination of the sticking is previously estimated before elimination of the sticking, and when it is decided that such variation in output is larger than a predetermined value, the output from the internal combustion engine is reduced. This ensures that an excessive reduction of the output is prevented.

Yet further, according to the present invention, there is provided a fail-safe system for a throttle valve controller for controlling the opening and closing of a throttle valve in an internal combustion engine by a motor, comprising: a stick detecting means for detecting a sticking of the throttle valve; a stick elimination detecting means for detecting elimination of the sticking after detection of the sticking by the stick detecting means; an internal combustion engine output reducing means for reducing the output from the internal combustion engine when the elimination of the sticking is detected by the stick elimination detecting means; and an internal combustion engine output restoring means for gradually restoring the output from the internal combustion engine after the output has been reduced by the internal combustion engine output reducing means.

With the above construction, after reduction of the output from the internal combustion engine as a result of elimination of the sticking, the reduced output is gradually restored, ensuring that a smooth restoring to a normal operation is provided without any attendant sudden increase in output.

The above and other objects, features and advantages of the invention will become apparent from a reading of the following description of the preferred embodiment, taken in conjunction with the accompanying drawings.

BRIEF DESCRIPTION OF THE DRAWINGS

FIGS. 1 to 4 illustrate one embodiment of the present invention, wherein,

FIG. 1 is a schematic illustration of a construction of a vehicle equipped with a fail-safe system according to the present invention;

FIG. 2 is a block diagram illustrating an electronic control unit; and

FIGS. 3 and 4 are flow charts illustrating the contents of a control carried out in the electronic control unit.

DESCRIPTION OF THE PREFERRED EMBODIMENT

The present invention will now be described by way of one embodiment in connection with the accompanying drawings.

Figure 1:
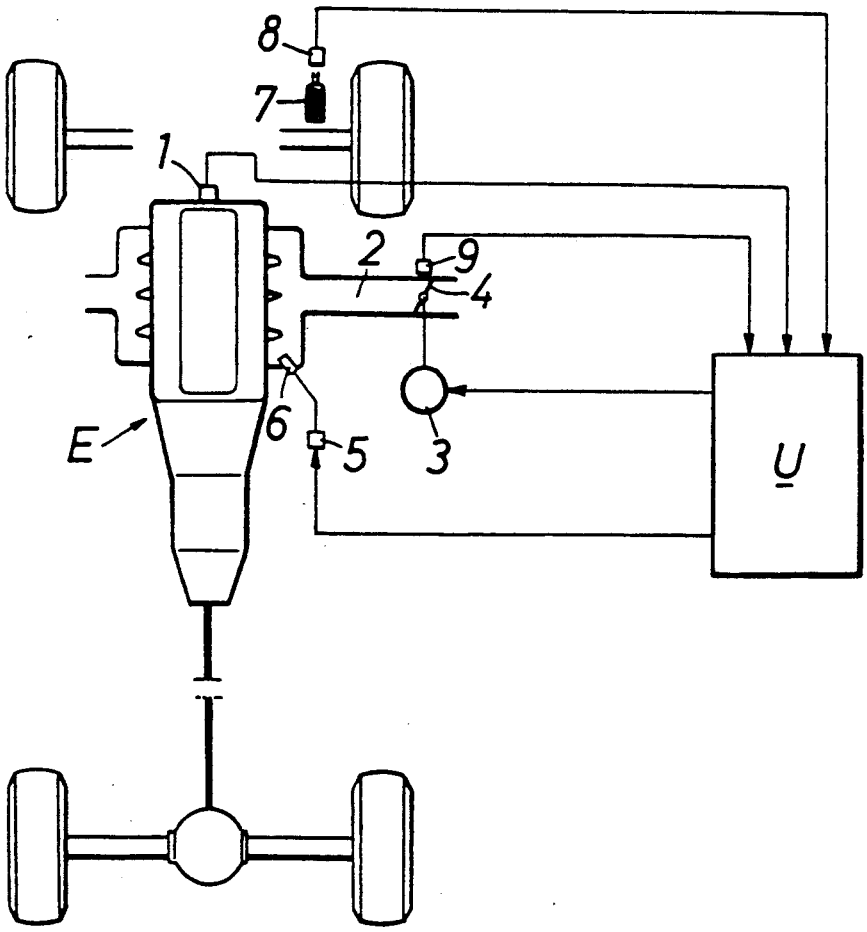

FIG. 1 is a schematic illustration of a construction of a vehicle equipped with a fail-safe system according to the embodiment of the present invention. A four-cylinder internal combustion engine E in this vehicle comprises a rotational speed detector 1 formed of a gear and an electromagnetic pick-up for detecting the rotational speed Ne of a crankshaft of the engine E, and a throttle valve 4 mounted in an intake passage 2 and driven for opening and closing by a pulse motor 3 as a motor according to the invention through a lost motion mechanism. Further, a fuel injection valve 6 is mounted at a downstream end of the intake passage 2 and includes a fuel cut means 5. An accelerator pedal 7 is provided with an accelerator pedal opening degree detector 8 for detecting the opening degree for the accelerator pedal 7, and the throttle valve 4 is provided with a throttle valve opening degree detector 9 for detecting the opening degree of the throttle valve 4. The rotational speed detector 1, the pulse motor 3, the fuel cut means 5, the accelerator pedal opening degree detector 8 and the throttle valve opening degree detector 9 are connected to an electronic control unit U which is constructed, for example, as a microcomputer.

Incidentally, the lost motion mechanism of this embodiment (particularly for traction control use) is effective only on the valve closing side and the pulse motor 3 is energized only at the time of valve closing control operation in which the lost motion mechanism acts. When energization of the pulse motor 3 is cut off, the lost motion action disappears due to the function of a spring within the lost motion mechanism and there is brought about a state wherein the accelerator pedal opening degree and the throttle valve opening degree can be adjusted mechanically.

Figure 2:
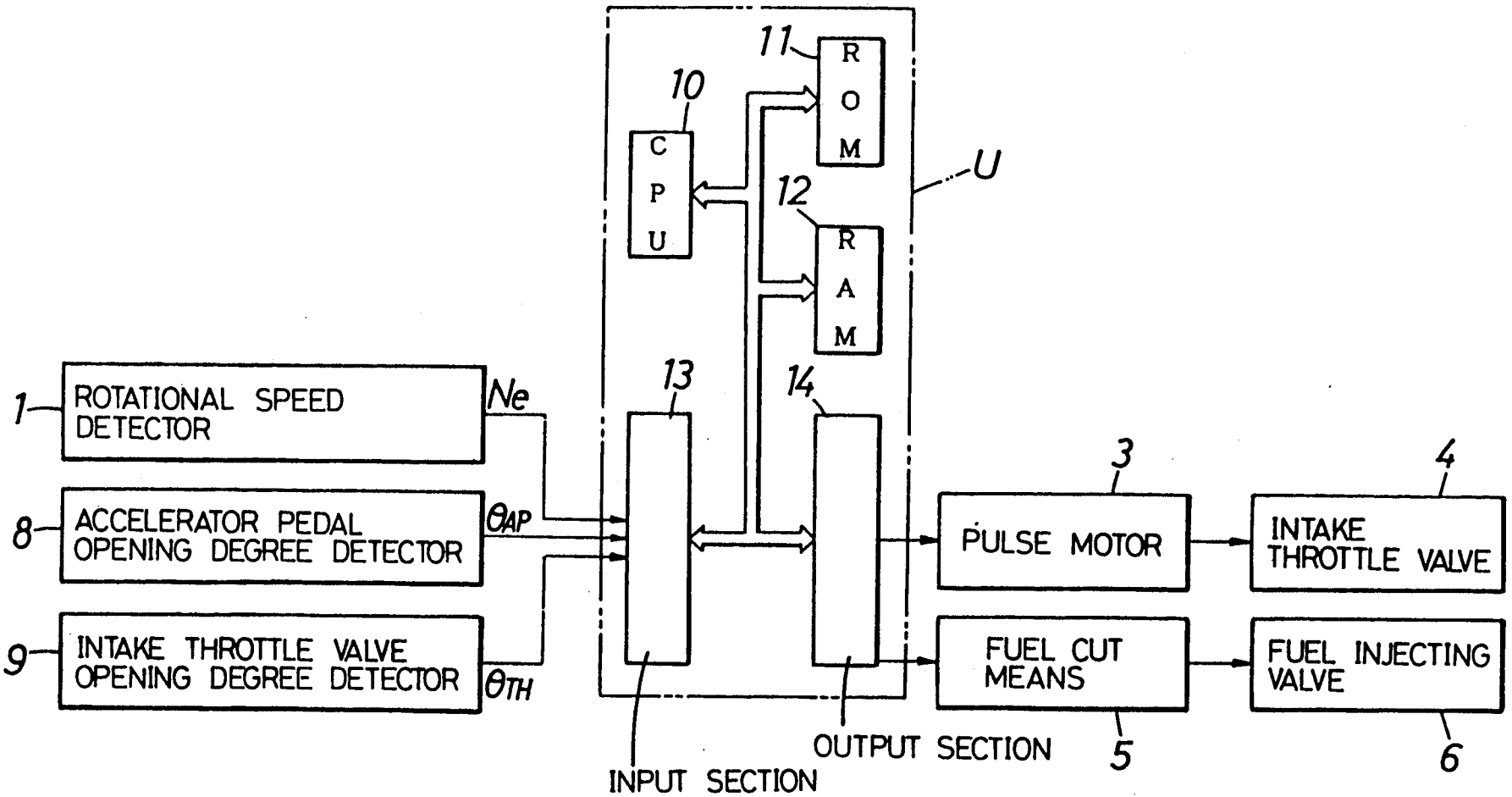

FIG. 2 illustrates the electronic control unit U which calculates detection signals received therein from the above-described detectors according to a control program to drive the pulse motor 3 and the fuel cut means 5. The electronic control unit U is comprised of a central processing unit (CPU) for effecting the above calculation, a read-only memory (ROM) 11 having the control program and data such as various maps stored therein, a random access memory (RAM) 15 which temporarliy stores the detection signals from the detectors and calculation results, an input section 13 to which are connected the detectors, i.e., the rotational speed detector 1, the accelerator pedal opening degree detector 8 and the throttle valve opening degree detector 9, and an output section 14 to which are connected the pulse motor 3 and the fuel cut means 5. Thus, the electronic control unit U calculates the detection signals received therein through the input section 13 and the data stored in the read-only memory 11 by the central processing unit 10 according to a control program which will be described hereinafter, and finally drives the pulse motor 3 and the fuel cut means 5 through the output section 14, thereby controlling the output torque from the internal combustion engine E to a predetermined value.

Figure 3:
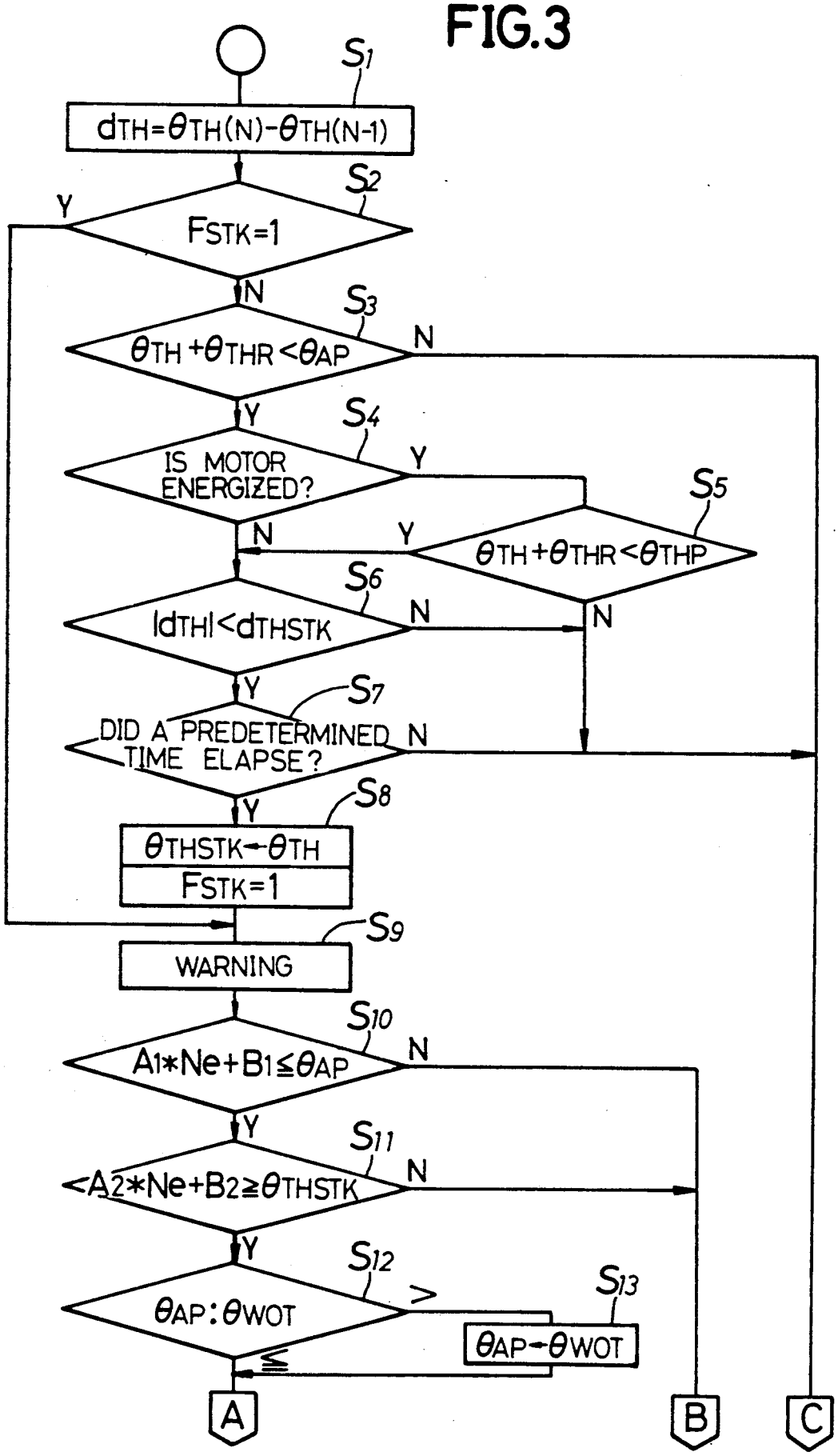
Figure 4:
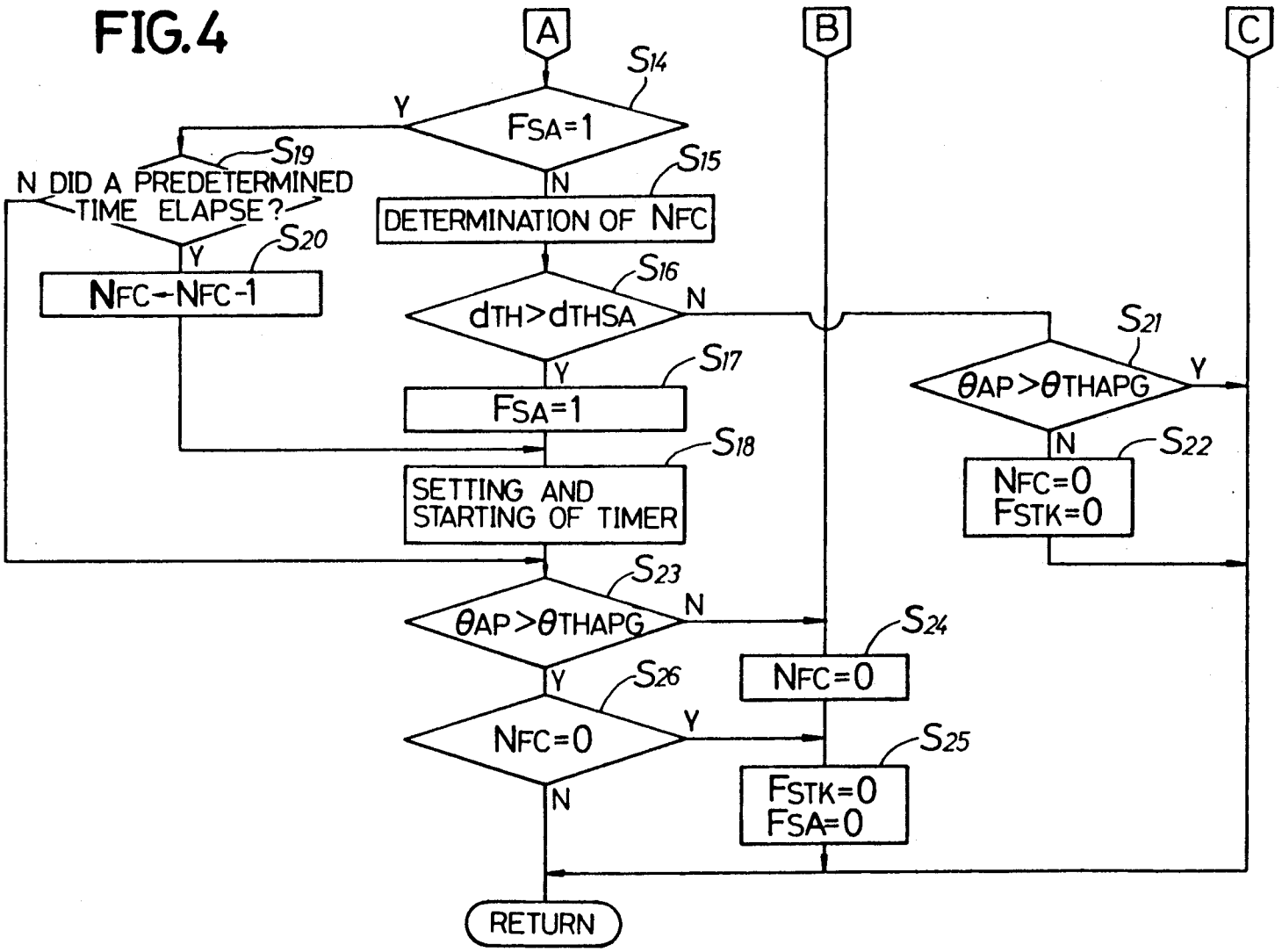

The contents of the control carried out in the electronic control unit U will now be described in detail in connection with flow charts in FIGS. 3 and 4.

At a step S1, a quantity of variation in throttle valve opening degree is found from a difference between the present value $\theta_{TH(N)}$ and the last value $\theta_{TH(N-1)}$ of throttle valve opening degree $\theta_{TH}$ detected at a predetermined intervals by the throttle valve opening degree detector 9. Then, it is decided at a step S2 whether or not a throttle valve stick flag $F_{STK}$ which will be described hereinafter has been set. If NO, it is decided at a step S3 whether or not a difference between an accelerator pedal opening degree $\theta_{AP}$ detected in the accelerator pedal opening degree detector 8 and the above-described throttle opening degree $\theta_{TH}$ is larger than a decision value $\theta_{THR}$. If the difference between the accelerator pedal opening degree $\theta_{AP}$ and the above-described throttle opening degree $\theta_{TH}$ is smaller than the decision value $\theta_{THR}$, that is, if an actual throttle valve opening degree $\theta_{TH}$ follows the accelerator pedal opening degree $\theta_{AP}$ (in case of NO), the fuel cut means 5 is not operated on the basis of the decision that a sticking of the throttle valve 4 is not produced. On the other hand, if the difference between the accelerator pedal opening degree $\theta_{AP}$ and the throttle opening degree $\theta_{TH}$ is larger than the decision value $\theta_{THR}$ and the throttle valve opening degree $\theta_{TH}$ does not follow the accelerator pedal opening degree $\theta_{AP}$, resulting in a possibility of a sticking produced in the throttle valve 4, it is decided at a subsequent step S4 whether or not the pulse motor 3 for opening and closing the throttle valve 4 has been energized. If the pulse motor 3 is in deenergization, or if the pulse motor 3 is in energization and the difference between a throttle valve opening degree instruction value $\theta_{THP}$ and the throttle opening degree $\theta_{TH}$ is larger than the decision value $\theta_{THR}$ at a step S5, it is decided at a step S6 whether or not an absolute value of a variation quantity $d_{TH}$ of the throttle valve opening degree calculated in the step S1 is less than a reference value $d_{THSTK}$. If YRS at the step 6, i.e., if the variation quantity $d_{TH}$ of the throttle valve opening degree is smaller and a predetermined time has been elapsed at a step S7, it is decided that there is a stick produced in the throttle valve 4. At a step S8, the throttle valve opening degree $\theta_{TH}$ of that time is replaced by a throttle valve stick opening degree $\theta_{THSTK}$, and the throttle valve stick flag $F_{STK}$ is set. At a subsequent step 9, a throttle valve sticking alarm is given. It should be noted that if NO at the steps S5, S6 and S7, it is decided that there is no sticking produced in the throttle valve 4.

When it is decided in the above manner that there is a sticking produced in the throttle valve 4, it is decided at steps S10 and S11 whether or not a sudden increase in output is produced in the internal combustion engine E when the sticking is eliminated on the basis of the rotational speed Ne of the internal combustion engine E which is delivered by the rotational speed detector 1. More specifically, if $A_1 * Ne + B_1 \leqq \theta_{AP}$ is established at the step S11 (wherein $A_1$ and $B_1$ are each a constant), there is a possibility that the output from the internal combustion engine E may be suddenly increased when the sticking is eliminated because the accelerator pedal opening degree $\theta_{AP}$ is larger. Here, a value of $A_1 * Ne + B_1$ is a linear approximation of the output from the internal combustion engine corresponding to a non-load throttle valve opening degree at the Ne of that time. In addition, if $A_2 * Ne + B_2 \leqq \theta_{THSTK}$ is established at the step S11 (wherein $A_2$ and $B_2$ are each a constant), the throttle valve stick opening degree $\theta_{THSTK}$ of that time is smaller and in this case, there is a possibility that the output from the internal combustion engine E may be suddenly increased when the sticking is eliminated. Here, the value of $A_2 * Ne + B_2$ is determined to correspond substantially to the torque level at the full opening of the throttle valve. This makes the torque variation after release of a sticking very little in case the throttle opening degree has reached the full opening torque level already at the time of the sticking. If YES at the steps S10 and S11, an upper limit of the throttle valve opening degree $\theta_{TH}$ is provided at a value of $\theta_{WOT}$ at subsequent steps S12 and S13. This upper limit is set to correspond to such a throttle opening degree as providing a 95% of maximum engine output torque obtainable at the current number of engine revolution, and this limit value can be read out of a look-up table as a function of the number of engine revolution. This look-up table may be replaced by the value of $A_z * Ne + B_z$.

It should be noted that the accelerator pedal opening degree $\theta_{AP}$ is used at the step S10 as a parameter representing the output from the internal combustion engine after elimination of the sticking, but the throttle valve opening degree instruction value can be used in place of the $\theta_{AP}$ when use is made of a drive-by-wire system which will be described hereinafter.

If the throttle valve 4 is suddenly opened due to the elimination of the sticking to result in a fear of a sudden increase in output from the internal combustion engine E, the processing is advanced to a step S14. If a throttle valve seddenly-opening flag $F_{SA}$ is not set at the step S14, the number $F_{FC}$ of cylinders subjected to a cutting of fuel by the fuel cut means 5 is calculated at a step S15 according to the following expression:

$$N_{FC} = int\left(4 * \frac{\theta_{AP} - \theta_{THSTK}}{\theta_{AP} - \theta_{MIN}}\right)$$

("*int*" means rounding operation)

wherein $\theta_{MIN} = A_1 * Ne + B_1$ when $Ne \geqq A_3$, and $\theta_{MIN} = \theta$ when $Ne < A_3$, where $A_3$ is a constant.

It is to be noted that the numeral "4" on the right side in the expression for finding $N_{FC}$ is the number of cylinders in the internal combustion engine E and the fractional portion on the same side represents (the difference in engine output torque before and after sticking/-the torque produced by engine). Therefore, in this embodiment, the dependency of the torque variation in engine output upon the number of engine revolution has been disregarded. However, it may be arranged for accuracy that an arithmetic operation is conducted by the above expression after the values $\theta_{AP}$ and $\theta_{THSTK}$ are converted into torque values dependent upon the number of engine revolution. Furthermore, as a measure of simplifying the control to determine the number of cylinders to which fuel supply is cut, there may be used a measure of making such determination based on the engine intake vacuum and the number of revolution at the current time. In that case, it can be set that the said number of cylinders increases in response to a rise in the engine revolution when the engine is on a high-load side providing a high engine output.

Then, it is decided at a step S16 whether or not the variation quantity $d_{TH}$ of the throttle valve opening degree calculated in the step S1 is larger than the reference value $d_{THSA}$. If YES, the throttle suddenly-opening flag $F_{SA}$ is set at a step S17 on the basis of the decision that the throttle valve 4 is being suddenly opened, and the fuel-cutting in the internal combustion engine E is started by the fuel cut means 5.

If it is decided at the step S14 that the throttle valve 4 is being suddenly opened and the fuel-cutting has been already conducted, the processing is passed to a step S19. If it is decided at a step S18 that a predetermined time has been lapsed from the start of counting by a timer, the number $N_{FC}$ of fuel-cut cylinders determined at the step S15 is reduced by 1 (one), whereby the number $N_{FC}$ of the fuel-cut cylinders is successively reduced, so that the operational condition is smoothly brought into a normal condition.

On the other hand, if the variation quantity $d_{TH}$ of the throttle valve opening degree is smaller than the reference value $d_{THSA}$ at the step S16, i.e., if the opening rate of the throttle valve 4 is smaller than a predetermined value, the processing is passed to a step S21 on the basis of the decision that the sudden opening of the throttle valve 4 is not produced. At the step S21, the accelerator pedal opening degree $\theta_{AP}$ is compared with a reference value $\theta_{THAPG}$ used for deciding the fully-closed state of the accelerator pedal 7. If it is decided that the accelerator pedal opening degree $\theta_{AP}$ indicates the fully-closed state, the number $N_{FC}$ of the fuel-cut cylinders and the throttle valve stick flag $F_{STK}$ are reset at 0 (zero) at a step S22.

In addition, even if the throttle valve 4 is being suddenly opened, if it is decided at the step S23 that the accelerator pedal opening degree $\theta_{AP}$ indicates the fully-closed state, the number $N_{FC}$ of the fuel-cut cylinders is reset at 0 (zero) at a step S24 and further, the throttle valve stick flag $F_{STK}$ and the throttle valve suddenly-opening flag $F_{SA}$ are reset at 0 at a step S25. On the other hand, even if it is decided that the accelerator pedal opening degree $\theta_{AP}$ is not as much as the fully-closed state, if the number $N_{FC}$ of the fuel-cut cylinders has been reduced to 0 (zero), the throttle valve stick flag $F_{STK}$ and the throttle valve suddenly-opening flag $F_{SA}$ are reset at 0 (zero) at a step S25.

Although the embodiment of the present invention has been described in detail, it will be understood that the present invention is not limited the above embodiment, and various minor modifications in design can be made without departing from the scope of the present invention as set forth in claims.

For example, the present invention can be applied to a drive-by-wire system for controlling the throttle valve opening degree in response to the output from an acelertor pedal opening degree sensor. In this case, in place of the detection of the sticking and the elimination of the sticking on the basis of the throttle valve opening degree as in the embodiment, it is possible to detect the sticking and the elimination of the sticking on the basis of a current value flowing across the motor for driving the throttle valve and a torque value of the throttle valve shaft.

In addition, the fuel cut means has been employed as a means for reducing the output from the internal combustion engine other than the throttle valve in the embodiment, but in addition to the fuel cut means, it is possible to employ an ignition retard means, a means for inhibiting the operation of intake and discharge valves, or an exhaust gas throttle valve or the like. In this case, a decrement in output from the internal combustion engine is determined on the basis of a value of $\theta_{AP}-\theta_{THSTK}/\theta_{AP}-\theta_{MIN}$ calculated at the step S15. When the drive-by-wire system is emplyed, it is possible to further use a means for controlling the closing of a primary throttle valve or a second throttle valve by an auxiliary actuator as a means for reducing the output from the internal combustion engine.

What is claimed is:

1. A fail-safe system for a throttle valve controller for controlling the opening and closing of a throttle valve in an internal combustion engine by a motor, comprising:

a stick detecting means for detecting a sticking of said throttle valve; and an internal combustion engine output decrement calculating means for calculating, when the sticking is detected by the stick detecting means, an amount of output from the internal combustion engine to be reduced, based on a current operational condition of the internal combustion engine and an estimated value for an operational condition of the engine at the time of elimination of the sticking.

2. A fail-safe system for a throttle valve controller for controlling the opening and closing of a throttle valve in an internal combustion engine by a motor, comprising:

a stick detecting means for detecting a sticking of said throttle valve;

an alarm means for giving an alarm when the sticking is detected by said stick detecting means;

a stick elimination detecting means for detecting elimination of the sticking detected by said stick detecting means; and an internal combustion engine output reducing means for reducing the output from said internal combustion engine when the elimination of the sticking is detected by said stick elimination detecting means.

3. A fail-safe system for a throttle valve controller for controlling the opening and closing of a throttle valve in an internal combustion engine by a motor, comprising:

a stick detecting means for detecting a sticking of said throttle valve;

an intenal combustion engine output variation estimating means for estimating a difference in a variation of positive torque output from the internal combustion engine at the time of detecting elimination of the sticking, based on a throttle valve opening degree at a time when the sticking is detected by said stick detecting means and an estimated throttle valve opening degree after the elimination of the sticking; and an internal combustion engine output reducing means for reducing the output from the internal combustion engine in accordance with the difference in the positive torque output variation estimated by said internal combustion engine output variation estimating means.

4. A fail-safe system for a throttle valve controller for controlling the opening and closing of a throttle valve in an internal combustion engine by a motor, comprising:

a stick detecting means for detecting a sticking of the throttle valve;

a stick elimination detecting means for detecting elimination of the sticking after detection of the sticking by said stick detecting means;

an internal combustion engine output reducing means for reducing the output from the internal combustion engine when the elimination of the sticking is detected by said stick elimination detecting means; and an internal combustion engine output restoring means for gradually restoring the output from the internal combustion engine after said output has been reduced by said internal combustion engine output reducing means.

5. A fail-safe system for a throttle valve controller according to any of claims 1 to 4, wherein said stick detecting means includes an accelerator pedal opening degree detecting means, a throttle valve opening degree detecting means, and a first opening degree difference determination means for deciding that the throttle valve is in a stuck state when a difference between an accelerator pedal opening degree detected by said accelerator pedal opening degree detecting means and a throttle valve opening degree detected by said throttle valve opening degree detecting means is equal to or more than a predetermined value.

6. A fail-safe system for a throttle valve controller according to claim 5 wherein said stick detecting means further includes a throttle valve opening degree variation quantity determination means for deciding that the throttle valve is in a stuck state when a quantity in variation of the throttle opening degree found on the basis of the throttle valve opening degree detected by said throttle valve opening degree detecting means is equal to or less than a predetermined value.

7. A fail-safe system for a throttle valve controller according to any of claims 1 to 4, wherein said stick detecting means includes a throttle valve opening degree instruction means for producing a throttle valve opening degree instruction value for said motor, a throttle valve opening degree detecting means, and a second opening degree difference determination means for deciding that the throttle valve is in a stuck state when a difference between said throttle valve opening degree instruction value and the throttle valve opening degree given from said throttle valve opening degree detecting means is equal to or more than a predetermined value.

8. A fail-safe system for a throttle valve controller according to claim 7, wherein said stick detecting means further includes a throttle valve opening degree variation quantity determination means for deciding that the throttle valve is in a stuck state when a quantity in variation of the throttle opening degree found on the basis of the throttle valve opening degree detected by said throttle valve opening degree detecting means is equal to or less than a predetermined value.

9. A fail-safe system for a throttle valve controller according to claim 2, further including an internal combustion engine output restoring means for gradually restoring the output of the internal combustion engine when a reduction in the output has been carried out.

10. A fail-safe system for a throttle valve controller according to claim 1, wherein said current operational condition of the engine and said estimated value for the operational condition of the engine at the time of elimination of the sticking to be used for the internal combustion engine output decrement calculating means are represented by a throttle valve opening degree and an accelerator pedal opening degree, respectively, at the time of sticking.

11. A fail-safe system for a throttle valve controller according to claim 1, wherein reduction in the output from the internal combustion engine is carried out in response to an output from an internal combustion engine output variation quantity detecting means which decides that the output from the internal combustion engine which is varied before and after elimination of the sticking can produce a positive torque.

12. A fail-safe system for a throttle valve controller according to claim 1, wherein the amount of decrement in the engine output calculated by said internal combustion engine output decrement calculating means is found on the basis of an accelerator pedal opening degree, a throttle valve opening degree during sticking, and the number of revolutions of the internal combustion engine.

13. A fail-safe system for a throttle valve controller according to claim 1, wherein reduction in the output from the internal combustion engine is carried out in response to an output from a stick elimination detecting means which decides that a quantity in variation of a throttle valve opening degree detected by a throttle valve opening degree detecting means after detection of the sticking is equal to or more than a predetermined value.

14. A fail-safe system for a throttle valve controller according to claim 13, wherein reduction in the output from the internal combustion engine carried out in response to an output from said stick elimination detecting means is prohibited when it is judged that a variation in the output from the internal combustion engine is small on the basis of a predicting means which performs a prediction for the variation in the output from the engine upon elimination of a sticking, when the sticking is detected by the stick detecting means.

15. A fail-safe system for a throttle valve controller according to claim 14, further including an internal combustion engine output restoring means for gradually restoring the output of the internal combustion engine when a reduction in the output has been carried out.

* * * * *